US010837283B2

(12) United States Patent
Heaps et al.

(10) Patent No.: US 10,837,283 B2
(45) Date of Patent: Nov. 17, 2020

(54) VACUUM PUMP WITH ECCENTRICALLY DRIVEN VANE (ECCENTRIC PUMP DESIGN WITH CRANK PIN)

(71) Applicant: WABCO Europe BVBA, Brussels (BE)

(72) Inventors: David Heaps, Haworth (GB); Simon Warner, Pontefract (GB)

(73) Assignee: WABCO EUROPE BVBA, Brussels (BE)

( * ) Notice: Subject to any disclaimer, the term of this patent is extended or adjusted under 35 U.S.C. 154(b) by 272 days.

(21) Appl. No.: 15/769,757

(22) PCT Filed: Nov. 13, 2015

(86) PCT No.: PCT/EP2015/002276
§ 371 (c)(1),
(2) Date: Apr. 20, 2018

(87) PCT Pub. No.: WO2017/080568
PCT Pub. Date: May 18, 2017

(65) Prior Publication Data
US 2019/0338781 A1 Nov. 7, 2019

(51) Int. Cl.

| | |
|---|---|
| ***F01C 21/08*** | (2006.01) |
| ***F04C 29/00*** | (2006.01) |
| ***F04C 25/02*** | (2006.01) |
| ***F04C 18/344*** | (2006.01) |
| ***F04C 23/00*** | (2006.01) |

(52) U.S. Cl.
CPC ..... *F01C 21/0827* (2013.01); *F04C 18/3441* (2013.01); *F04C 25/02* (2013.01); *F04C 29/0057* (2013.01); *F04C 23/008* (2013.01)

(58) Field of Classification Search
CPC ..... F01C 21/0827
See application file for complete search history.

(56) References Cited

U.S. PATENT DOCUMENTS

| | | | | |
|---|---|---|---|---|
| 6,926,505 | B2 * | 8/2005 | Sbarounis | F01C 1/22 418/125 |
| 2010/0000207 | A1 | 1/2010 | Heaps et al. | |
| 2014/0170010 | A1 * | 6/2014 | Kwak | F01C 21/10 418/83 |

FOREIGN PATENT DOCUMENTS

| | | | |
|---|---|---|---|
| DE | 4020087 | A1 | 1/1992 |
| EP | 0465807 | A2 | 1/1992 |
| EP | 2024641 | A1 | 2/2009 |
| EP | 2249040 | A2 | 11/2010 |
| EP | 2987951 | A1 | 2/2016 |
| WO | WO 2009052929 | A1 | 4/2009 |
| WO | WO 2009052930 | A2 | 4/2009 |

* cited by examiner

*Primary Examiner* — Mary Davis
(74) *Attorney, Agent, or Firm* — Leydig, Voit & Mayer, Ltd.

(57) ABSTRACT

A vacuum pump includes a housing defining a cavity having an inlet and an outlet; a vane member for a rotary driven movement inside the cavity; a drivable rotor inside the cavity; and a rotatable central shaft extending to the cavity. The vane member is slidably arranged in the rotor. The rotor is rotatable together with the vane member. The central shaft comprises a crank pin configured to engage a respective guiding recess of the rotor for driving the rotor at least along a first predetermined rotational angle.

20 Claims, 11 Drawing Sheets

VACUUM PUMP WITH ECCENTRICALLY DRIVEN VANE (ECCENTRIC PUMP DESIGN WITH CRANK PIN)

CROSS REFERENCE TO RELATED APPLICATIONS

This application is a U.S. National Stage Application under 35 U.S.C. § 371 of International Application No. PCT/EP2015/002276 filed on Nov. 13, 2015. The International Application was published in English on May 18, 2017 as WO 2017/080568 A1 under PCT Article 21(2).

FIELD

The invention relates to a vacuum pump, in particular a rotating vacuum pump including a vane member for a rotary driven movement inside a cavity. Furthermore, the invention relates to a method for driving a vacuum pump, in particular a vacuum pump of the aforementioned type.

BACKGROUND

Rotating vacuum pumps including a vane member for a rotatory driven movement inside a cavity may be fitted to road vehicles with gasoline or diesel engines. The vacuum pump is driven by a cam shaft of the engine, an electric motor or a belt drive. Vane pumps of the aforementioned type typically comprise a housing defining a cavity having an inlet and an outlet and a vane member for rotary driven movement inside the cavity. The housing may include a cover which encloses the cavity. The vane member is typically movable to draw fluid into the cavity through the inlet and out of the cavity through the outlet so as to induce a reduction in a pressure at the inlet. The inlet is connectable to a consumer such a brake booster or the like.

According to a first type of vacuum pumps, which are of the vane pump type, the rotor is driven and comprises a radially arranged slot in which the vane may freely slide and the vane is further guided by the cavity walls. Such vane pumps are oil lubricated due to wear between the vane tips and the cavity walls. A comparable vane pump is for example disclosed in EP 2 024 641 or EP 2 249 040. Such vane pumps are also called mono vane pumps, since they incorporate only one single vane which is slidable in a radial direction of the rotor without additional guiding or driving means. The rotor typically is directly connected via a drive shaft to a motor.

Further, vacuum pumps having multiple vanes which are separately guided and supported on a supporting surface are also known, as for example shown in DE 40 20 087 or EP 0 465 807. Such vacuum pumps have the disadvantage that they incorporate multiple individual parts and multiple friction surfaces which makes it difficult to seal them against the environment to effectively induce a vacuum inside the cavity. In such vacuum pumps again, the rotor typically is fixedly connected to a central drive shaft which is driven by a motor.

From WO 2009/052929 a vacuum pump is known, comprising a housing defining a cavity having an inlet and an outlet, and a drivable vane member for a rotary driven movement inside the cavity and a rotor inside the cavity. The vane is arranged in a radial slot of the rotor. Further, the vacuum pump comprises an excenter shaft with a stroke pin which is coupled to the vane. The rotary axis of the excenter shaft is offset from the rotary axis of the rotor, and the rotary axis of the stroke pin is offset from the rotary axis of the excenter shaft. The vane is guided by means of the excenter shaft and the stroke pin. In general, the principle movement of such a vacuum pump is comparable to the principle of rotary piston pumps, as for example described in GB 338, 546.

SUMMARY

In an embodiment, the present invention provides a vacuum pump including a housing defining a cavity having an inlet and an outlet; a vane member for a rotary driven movement inside the cavity; a drivable rotor inside the cavity; and a rotatable central shaft extending to the cavity. The vane member is slidably arranged in the rotor. The rotor is rotatable together with the vane member. The central shaft comprises a crank pin configured to engage a respective guiding recess of the rotor for driving the rotor at least along a first predetermined rotational angle.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
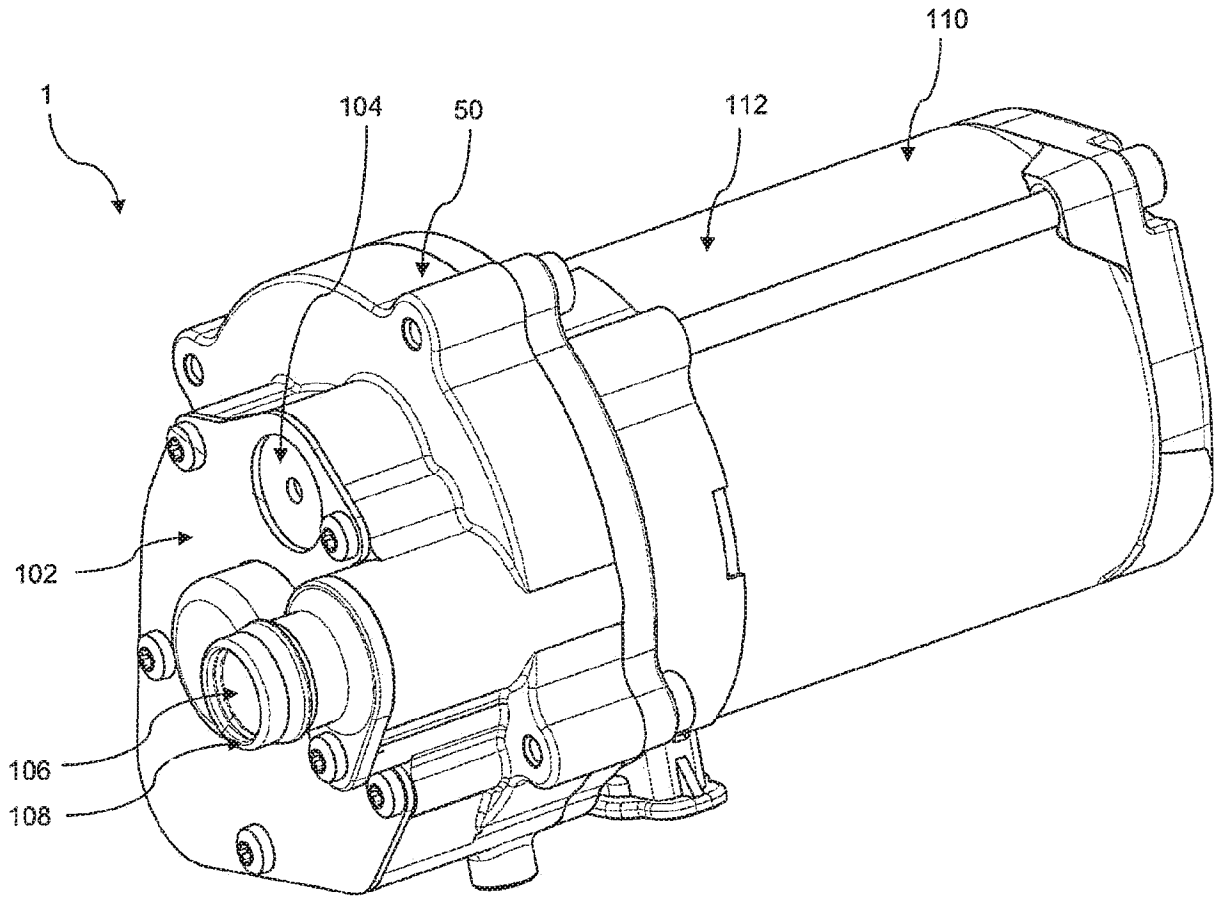
FIG. 1 shows a perspective view of a vacuum pump.

A problem associated with such eccentrically driven vacuum pumps or cranked vanes, is that when the axis of the stroke pin passes across the rotary axis of the rotor, the effective moment arm becomes zero and the driving force of the crank pin only directs in a direction of the plane of the vane, thus pushing the vane against the cavity wall. This is less problematic when using a lubricated vacuum pump, however, problematic when using a dry running vacuum pump.

A further problem related with such vacuum pumps is the sealing of the cavity against the environment for achieving an effective generation of vacuum. It is preferred to use few parts and to move the vane with a close relationship to the cavity wall but without touching it to reduce wear and avoid maintenance. At the same time it is preferred to use slow running vacuum pumps, as the one disclosed in WO 2009/052929, in which the vane rotates at half speed of the drive shaft.

One or more embodiments of the invention provide a vacuum pump for sealing of a cavity against the environment, for effectively inducing a vacuum inside the cavity while being able to rotate the vane at half speed of the drive shaft, and which is usable as a dry running vacuum pump.

One or more embodiments of the invention provide rotating vacuum pumps including a housing defining a cavity having an inlet and an outlet, a vane member for a rotary driven movement inside the cavity, a drivable rotor inside the cavity, a rotatable central shaft extending to the cavity, wherein the vane member is slidable arranged in the rotor, the rotor being rotatable together with said vane member. Furthermore, one or more embodiments of the invention provide such a vacuum pump in which the central shaft comprises a crank pin engaging a respective guiding recess of the rotor for driving the rotor at least along a first predetermined rotational angle.

Instead of driving the rotor directly and permanently, one or more embodiments of the invention drive the rotor by means of a crank pin, which is eccentrically arranged at the central shaft and which engages a guiding recess of the rotor. The crank pin and the guiding recess preferably act together to form a sliding block guide to ensure rotation of the rotor when it is needed. It is possible and preferred that also the vane is coupled to a drive.

According to a first preferred embodiment, the guiding recess is in the form of a groove. The guiding recess has a longitudinal extension and is able to guide the crank pin along a predetermined path relative to the rotor.

The groove preferably extends in a direction substantially perpendicular to a plane defined by the vane member, or at least in a slanted angle relative to the plane defined by the vane member. The plane defined by the vane member is the plane in which the vane moves relative to the rotor. Such an arrangement helps to provide an effective moment arm relative to the vane member and thus to ensure even and effective rotation.

According to a further preferred embodiment, the guiding recess comprises at least one narrow portion having a first width substantially corresponding to the outer diameter of the crank pin, and at least a wide portion having a second width substantially larger than the outer diameter of the crank pin. The wide portion is preferably formed such that the crank pin disengages the rotor when the crank pin is in the wide portion. According to this embodiment, the crank pin only engages the rotor when it is in the range of the narrow portion. Due to this embodiment, it is possible to define specific section of the rotors revolution when the rotor should be driven. Preferably, the wide portion is located in the central area of the groove, while two narrow portions are provided, at axial ends of the guiding recess. Thus, it becomes possible to transmit driving force from the crank pin on the rotor at two positions of the revolution of the rotor, for example in an area around 0° and an area around 180°.

Preferably, an axial length of the wide portion is in the range of ⅔ of a moving length of the crank pin in the guiding recess. The moving length of the crank pin in the guiding recess is defined by the length between the central axis of the crank pin, when at first and second end points of the guiding recess. Thus, it is preferable that two narrow portions are provided at both end portions of the guiding recess such that the crank pin engages the guiding recess in the area of the end portions.

Preferably, the guiding recess is formed such that the first predetermined rotor rotational angle is in the range of 20° to 5°, preferably 15° to 5°, more preferably 15° to 10°. In particular, when using a vane member which is driven by a crank mechanism, the effective moment arm becomes zero when the crank of the vane member is in the area of the rotation axis of the rotor. For overcoming the small or close to zero moment arm, the additional drive of the rotor can be used, and it is typically sufficient to drive the rotor for about 20° to 5°, preferably 15° to 5°, more preferably 15° to 10°. A value about 15° has shown to be sufficient in most applications.

Furthermore, it is preferred that the guiding recess is formed as a blind recess. The guiding recess is thus not formed as a through hole or a through groove. This in particular is preferably with respect to sealing issues.

According to a further preferred embodiment, the crank pin comprises a pin sleeve for contacting wall portions of the guiding recess. Due to such a bearing sleeve, wear due to contact between the crank pin and wall portions of the guiding recess can be reduced.

In a further preferred embodiment of the invention, the vane member is coupled to the central shaft by means of an eccentric element on the central shaft. Preferably, the rotor in this embodiment is rotatable together with said vane member upon rotation of the vane member for at least a second predetermined rotational angle. Preferably, a rotational axis of the central shaft is offset from the rotational axis of the rotor and the point of action of the vane member is offset from the rotational axis of the central shaft by means of the eccentric element on the central shaft. Furthermore, it is preferred that the rotor radially encloses the eccentric element of the central shaft. According to such an embodiment, a second drive for driving the vane member is provided. The second drive for driving the vane member in this embodiment is formed as an eccentric drive, as described in the earlier European patent application 14002924.0 in the name of WABCO Europe BVBA. On the central shaft, additionally to the crank pin, an eccentric element is provided which is offset from the rotational axis of the central shaft. In this regard a main axis, a central axis, a rotational axis or a point of engagement from the eccentric element is offset from the rotational axis of the central shaft. A vane member is coupled to the central shaft by means of the eccentric element so that the vane member is drivable upon rotation of the central shaft. Preferably, the rotor encloses the eccentric element of the central shaft radially. Preferably, the rotor encloses the crank pin. In other words, the eccentric element and the crank pin are packed within the rotor. In rotation, the eccentric element moves back and forth relative to the rotor, as well as the crank pin moves back and forth relative to the rotor, since the rotational axis of the central shaft is offset from the rotational axis of the rotor and the eccentric element is eccentrically provided on the central shaft. When the rotor radially encloses the eccentric element, the rotor also radially encloses the central shaft. Therefore, also a passage through which the central shaft extends into the cavity is radially enclosed by the rotor.

Thus, it is sufficient to seal the rotor against the cavity and no additional gaps, slots or passages for the central shaft are present in the cavity defined between the rotor and the circumferential in a wall formed by the housing of the cavity. Due to the fact that the eccentric element is radially enclosed by the rotor, the eccentric element does not move "outside" the rotor upon rotation of the central shaft and the rotor. Therefore, additional sealing points can be omitted and the overall sealing of the vacuum pump is enhanced.

Preferably, the rotor comprises a substantially cylindrical outer wall and defines an inner space, wherein said eccentric element of the central shaft moves back and forth in a radial direction of the rotor when the central shaft is in rotation. Thus, the eccentric element, the central shaft and also the coupling between the eccentric elements and the vane member are arranged inside the inner space of the rotor and therefore packed within the rotor.

The outer wall of the rotor may comprise any suitable shape. Preferably the outer wall of the rotor has a substantially cylindrical shape. This leads to a more simple sealing arrangement. Preferably the housing defining the cavity comprises a substantially flat bottom surface and a substantially flat top surface and a circumferential wall connecting the bottom and the top surfaces.

The bottom surface is preferably formed by a bottom plate which may be integral with the casing. The top surface is preferably formed by an end plate which may be a cover plate. The rotor preferably extends from the bottom surface to the top surface and is sealed against the same. Due to the fact that the eccentric element of the central shaft moves back and forth in a radial direction of the rotor and is arranged in the inner space of the rotor, only the rotor needs to be sealed against the bottom surface and the top surface thus providing an enhanced sealing arrangement of the vacuum pump.

Further it is preferred that the inner space of the rotor has an inner diameter which is at least twice the maximum offset of the central axis of the eccentric element and the rotational axis of the rotor. The maximum offset of the central axis of the eccentric element and the rotational axis of the rotor can also be interpreted as the maximum stroke of the eccentric element relative to the fixed rotational axis of the rotor. Thus, when the inner space of the rotor has an inner diameter according to this embodiment, it is ensured that the eccentric element and thus the coupling between the vane member and the eccentric element is permanently arranged inside the rotor and no additional connecting points which need to be sealed are present inside the cavity. This further leads to an improved sealing of the vacuum pump and to an effective generation of vacuum.

Preferably, the rotor wall comprises first and second slots in first and second opposing positions on a radial direction, such that the vane member is slidable in the radial direction of the rotor when the central shaft and/or the rotor is in rotation. The first and second slots form guides for the vane member. Preferably the vane member is only coupled to the rotor by means of these slots. The vane member is preferably sealed against the rotor at these slots, for example by means of a close relationship or additional sealing means such as elastomeric or rubber lips or the like.

Particularly preferred, the central shaft, the rotor and the vane member are positively coupled together. Thus, the three main moving parts, namely the central shaft, on which the eccentric element is provided, the rotor and the vane member always have a geometrically defined relationship to each other.

Therefore it is possible to drive and move the vane member based only on the positive coupling between the central shaft, the rotor and the vane member and it is not necessary to guide the vane member by means of the inner circumferential wall of the cavity. Thus the vane member does not necessarily touch the wall. Therefore frictional losses of the vacuum pump can be omitted.

Furthermore it becomes possible to improve the sealing between the vane member and the inner circumferential wall of the cavity since the vane member is not guided by the wall leading to a reduction of losses between the vane member and the inner circumferential wall.

Preferably, the central shaft rotates twice the rotational angle of the rational angle of the vane member and rotor. Thus, when for example the central shaft rotates about an angle of 180°, the vane member and the rotor rotate about an angle of 90°. Therefore the central shaft rotates twice as fast as the rotor and the vane member. This transmission between the central shaft and the rotor occurs due to the specific coupling of the parts and the geometrical properties which define that the vane member is coupled to the central shaft by means of the eccentric element on the central shaft and the rotational axis of the central shaft is offset from the rotational axis of the rotor and the point of action of the vane member is offset from the rotational axis of the central shaft by means of the eccentric element on the central shaft. Thus it becomes possible to rotate the rotor and the vane at half the speed of the central shaft. This may be beneficial when for example the central shaft is driven by means of an electric motor having a high output speed. In many applications a slower rotation of the vane member is sufficient to provide a desired vacuum. Incorporating the transmission between the central shaft which may form the drive shaft and the vane member leads to a reduction in loads and stresses on the moving parts of the vacuum pump which enhances the lifetime of the vacuum pump.

According to a further preferred embodiment, the vane member is drivable and the guiding recess is formed such that the crank pin engages the rotor when a drive moment of the vane member becomes low, in particular only engages the rotor when a drive moment of the vane member becomes low. A drive moment of the vane member which becomes low is defined as a moment which is close to zero, in particular 10% or less, preferably 5% or less of the maximum drive moment in normal operation. At such point of time and such point of the revolution of the rotor respectively, it is preferred that not only the vane is driven, but that additionally the rotor is driven by means of the crank pin engaging the guiding recess, to provide an even rotation and avoid forcing the vane member against the inner circumferential wall. This allows to form the vacuum pump as a dry running vacuum pump and avoid lubrication of the vacuum pump.

According to a further preferred embodiment, the eccentric element is formed as an eccentric bushing which is eccentrically arranged on the drive shaft. Preferably, the eccentric element is non-rotatable coupled to the drive shaft by means of the crank pin. Preferably, the crank pin and the drive shaft are formed as a one-piece and the eccentric element in the form of a bushing is mounted about the central shaft within the crank pin. This allows an easy assembly of the vacuum pump and it is possible to form the eccentric element out of a different material than the drive shaft. Furthermore, this allows using various geometries of the eccentric element allowing to use the same drive shaft in different applications. Preferably, the axis of the crank pin, the rotational axis of the drive shaft and the central axis of the eccentric element are arranged in the same plane. This allows to form the crank pin and the eccentric element in the form of a bushing such that no balance weight is needed for balancing the eccentric of the drive shaft. This arrangement also is beneficial when only used in an arrangement of a vacuum pump as disclosed in the earlier European patent application EP 14002924.0 and this aspect is being disclosed herein separately.

According to a further particular preferred embodiment the eccentric element is formed as a cam on the central shaft and the vane member comprises a central hollow jacket and the vane member is seated about the cam by means of the jacket. Preferably the cam forming the eccentric element has a substantially cylindrical shape having a circular cross-section. Preferably the cam forming the eccentric element has a larger diameter than the central shaft. Thus, the contacting surface between the eccentric element and the hollow jacket of the vane member is increased leading to an improved force transmission between the single parts. Additionally such an arrangement leads to a stable and substantially stiff arrangement of the parts which again leads to an improved sealing of the vacuum pump and an effective vacuum generation. According to such an embodiment the central axis of the cam is identical to the point of action of the vane member.

Particularly preferred is the vane member formed as a single one-piece vane member having first and second vanes on the hollow jacket protruding in a radial direction on opposing sides of the jacket. On the one hand such a vane member is easy to manufacture. On the other hand when the vane member is formed as a single one-piece, no connection points between the vanes and the hollow jacket are needed leading to a stiffer and more stable construction of the vane member which again is beneficial for the sealing of the vacuum pump against the environment.

Further it is preferred that the first offset of the rotational axis of the central shaft relative to the rotational rotor-axis of the rotor is substantially identical to the second offset of the point of action of the vane member relative to the rotational axis of the central shaft. This leads to a suitable matching of the moving parts and provide a proper movement.

The point of action is the central axis of the eccentric element. When the axis of the eccentric element passes across the axis of the rotor, the length of the effective moment arm becomes zero and no drive is transmitted for a short section of the revolution. A crank pin in this section transmits a force directly to the rotor and thus, an even rotation is obtained.

According to a particular preferred embodiment the rotor comprises at least one bearing journal for bearing the rotor against a bottom plate and/or an end plate of the cavity. The bottom plate preferably forms the bottom surface of the cavity and the end plate preferably forms the top surface of the cavity. In general the bottom plate may be integrally formed with the housing. The end plate may be separate from the housing and formed as a cover which is fixed via screws or the like to the housing. The bearing journals are preferably formed as ring or ring segment shaped protrusions coaxially arranged with the rotational axis of the rotor. Such bearing journals are easy to manufacture and provide for a stable bearing of the rotor even during high rotational speeds. Alternatively the bearing journal is formed as at least two ring segments provided as protrusions on axial ends of the rotor. For example the ring segments can be arranged in such a way that the slots for the vane member are kept open, so that mounting the vane member to the rotor is possible in a simple and easy way.

According to a second aspect of the invention a vacuum pump is disclosed, in particular a rotating vane pump, comprising a housing defining a cavity having an inlet and an outlet, a drivable vane member for a rotary driven movement inside the cavity, a drivable rotor inside the cavity, a rotatable central shaft extending to the cavity, wherein the vane member is slidable arranged in a slot of the rotor, the rotor being rotatable together with said vane member, and wherein the drive shaft is coupled to the vane member by means of a first eccentric element and the rotor by means of a second eccentric element. Preferably, the first and second eccentric elements are non-rotatable to each other and non-rotatable to the drive shaft. Furthermore, it is preferred that the rotor and the vane member rotate at half speed of the drive shaft. It should be understood that the vacuum pump according to the second aspect of the present invention comprises identical and similar preferred embodiments, in particular as described in the dependent claims. Therefore, reference is made to the above description.

In a further aspect of the invention, the problem stated in the introductory portion is solved by a method for driving a vacuum pump, in particular a vacuum pump according to at least one of the beforehand described preferred embodiments of a vacuum pump, comprising the steps of directly driving a rotor along a first predetermined rotational angle and directly driving a vane member along a second predetermined rotational angle. Thus, along a first predetermined rotational angle, the rotor is driven and along a second predetermined rotational angle, the vane member is driven. Preferably, the rotor is indirectly driven by means of the vane member when the vane member is directly driven, and the vane member is indirectly driven when the rotor is directly driven. Furthermore, it is preferred that the first predetermined rotational angle is in the range of 20° to 5°, preferably 15° to 5°, more preferably 15° to 10°.

It should be understood that the method according to this aspect of the invention and the vacuum pump according to the first and second aspects of the invention comprise similar and identical preferred embodiments, as in particular described in the dependent claims. Insofar, reference is made to the above description regarding in preferred features and the technical effects.

A vacuum pump 1 (FIG. 1) comprises a housing 50. The housing 50 comprises a demountable end plate 102, in which an outlet 104 of the vacuum pump 1 is formed. The housing 50 further more comprises an inlet 106 which is provided with a connecting piece 108 which may receive a hose or the like of a consumer. The vacuum pump 1 is connected to a drive motor 110 having a motor housing 112.

Figure 3:
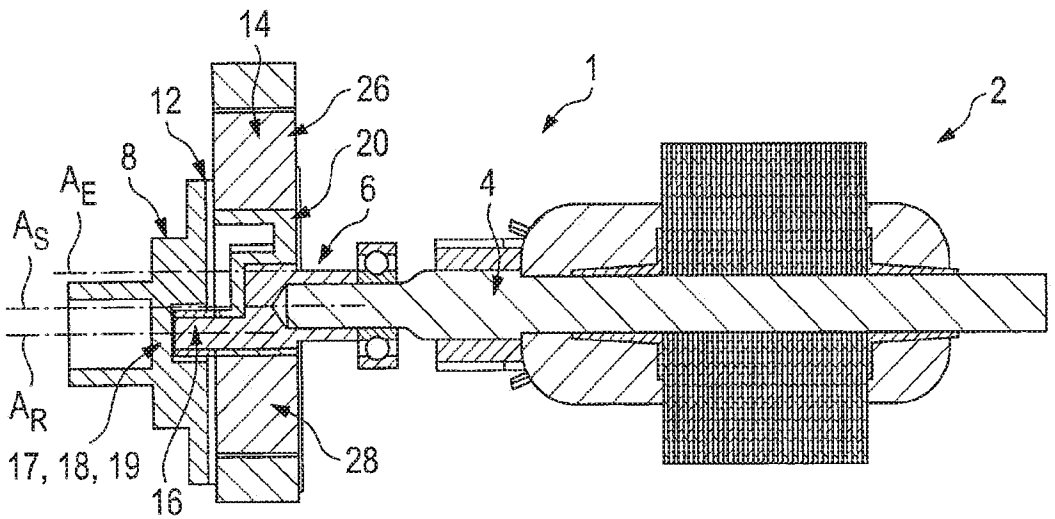
FIG. 3 shows a cross section along the plane Z-Z of FIG. 2.
Figure 4:
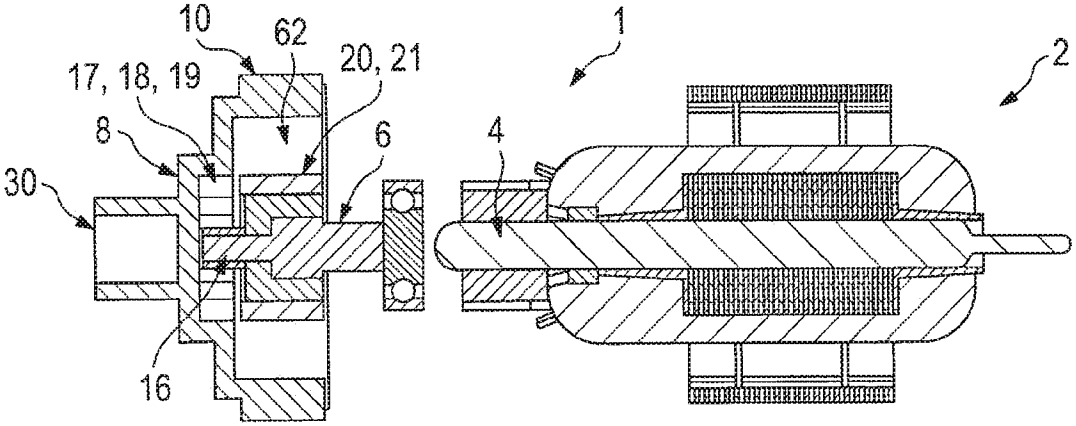
FIG. 4 shows a cross section along the plane Y-Y of FIG. 2.
Figure 2:
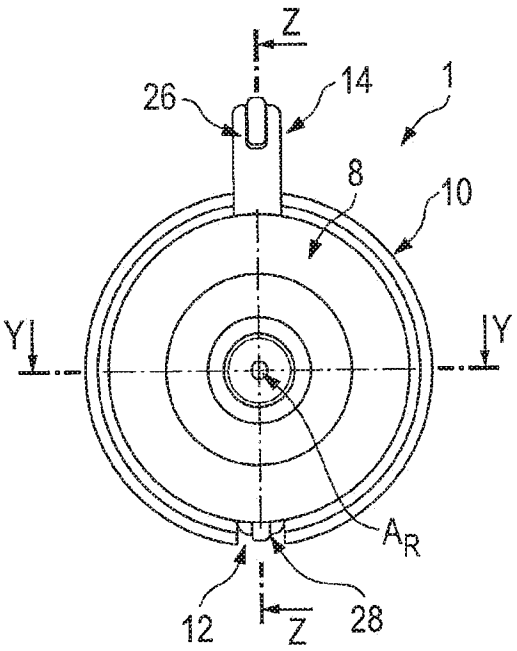
FIG. 2 shows a top view of a vacuum pump without housing.

According to FIGS. 2 to 4, a vacuum pump 1, which is for the sake of simplicity shown without housing 50, is connected with a drive motor 110, from which only the rotor 2 is shown. The rotor 2 comprises a motor shaft 4, connected to a central shaft 6 of the vacuum pump 1.

Figure 13:
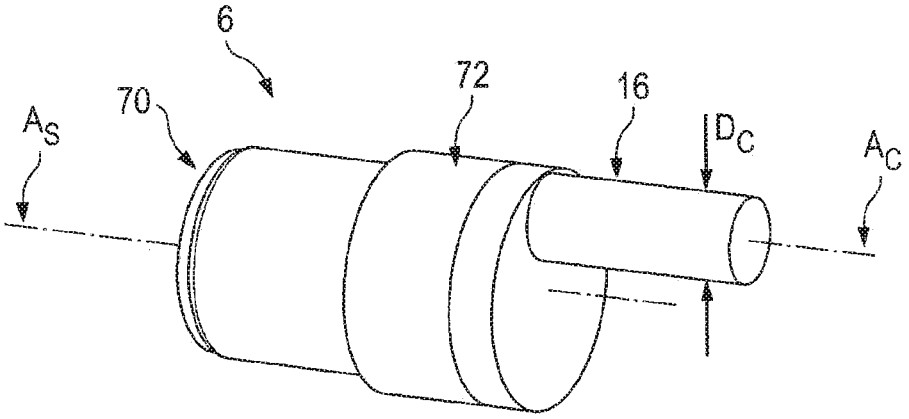
FIG. 13 shows an elevated view of the central shaft.

The vacuum pump 1 furthermore comprises a drivable rotor 8, which is rotatable about a rotation axis AR. The rotor 8 comprises a circumferential outer wall 10 having a slot 12, in which a vane member 14 is slidable arranged. The rotor 8 thus is being rotatable together with the vane member 14. The central shaft 6 comprises a crank pin 16 (cf. also FIG. 13) which engages a guiding recess 18 integrally formed in the rotor 8. Due to the engagement between the crank pin 16 and the guiding recess 18, the rotor 8 is drivable along a first predetermined angle $\alpha$, as will be described later.

According to this embodiment, also the vane member 14 is coupled to the drive shaft 6 and thus driven. This is not mandatory, the scope of the invention also covers vacuum pumps in which the vane 14 is passive and only indirectly driven by means of the rotor. Furthermore, alternative driving mechanisms for directly driving the vane member, at least along a second predetermined angle β, are preferred.

According to this embodiment, the vane member is seated about an eccentric element 20 on the central shaft 6. The eccentric element 20 according to this embodiment is formed as an eccentric bushing 20, which is fixed in a positive fitting connection to the crank pin 16 of the central shaft 6 (cf. also FIGS. 12, 14, 15). The eccentric element 20 comprises a cylindrical outer wall 22 and the vane member 14 comprises a central hollow jacket 24, which is rotatably seated about the circumferential outer surface 22 of the eccentric bushing 20. From the hollow jacket 24, two vanes 26, 28 extend in a common plane and protrude through the slot 12 formed in the rotor 8.

As can be seen in FIG. 3, the rotor comprises a rotational axis AR, which is offset to a rotational axis AS of the central shaft 6, and which both are offset of the central axis of the eccentric bushing 20, which forms the rotational axis AE of the vane member 14 relative to the eccentric bushing 20.

The rotor 8 furthermore comprises a shaft end 30 extending along the rotational axis AR of the rotor and being received in a cover of the vacuum pump 1 (not shown) for bearing the rotor 8.

Figure 5:
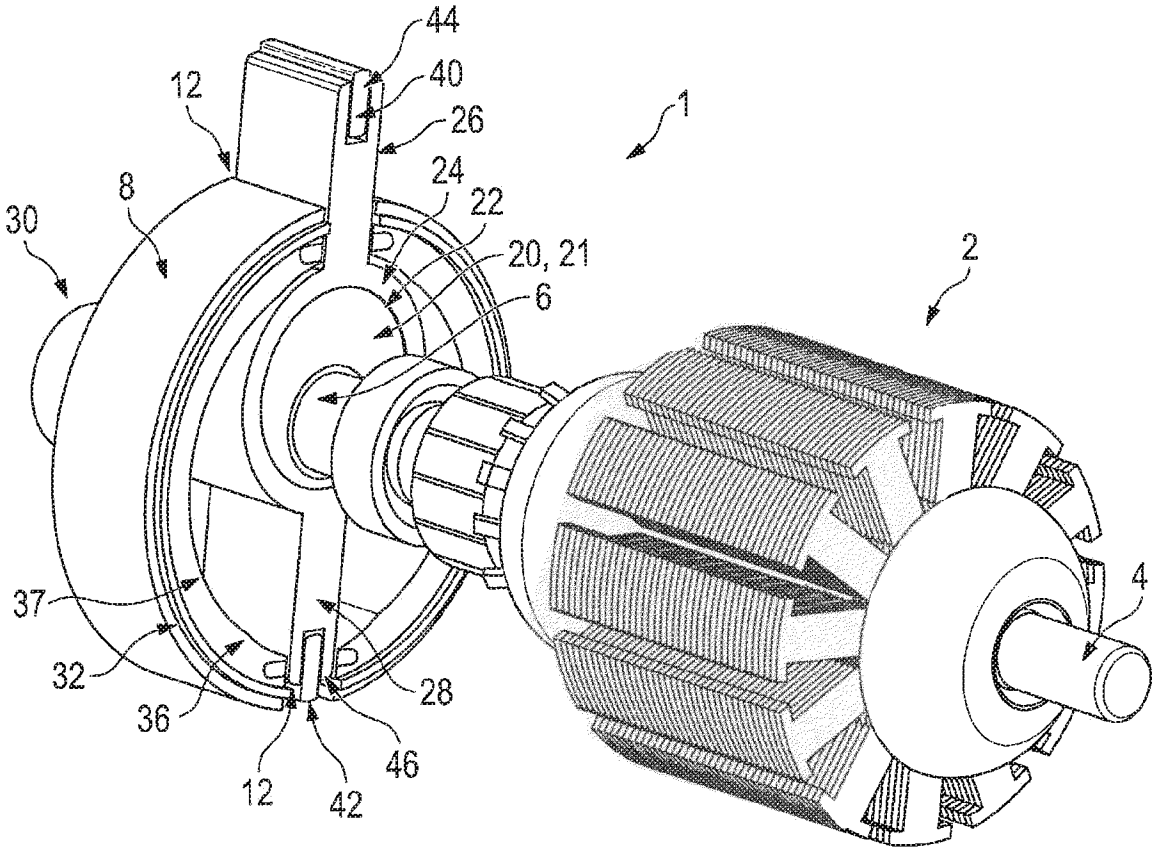
FIG. 5 shows an elevated view of the vacuum pump of FIGS. 2 to 4.
Figure 6:
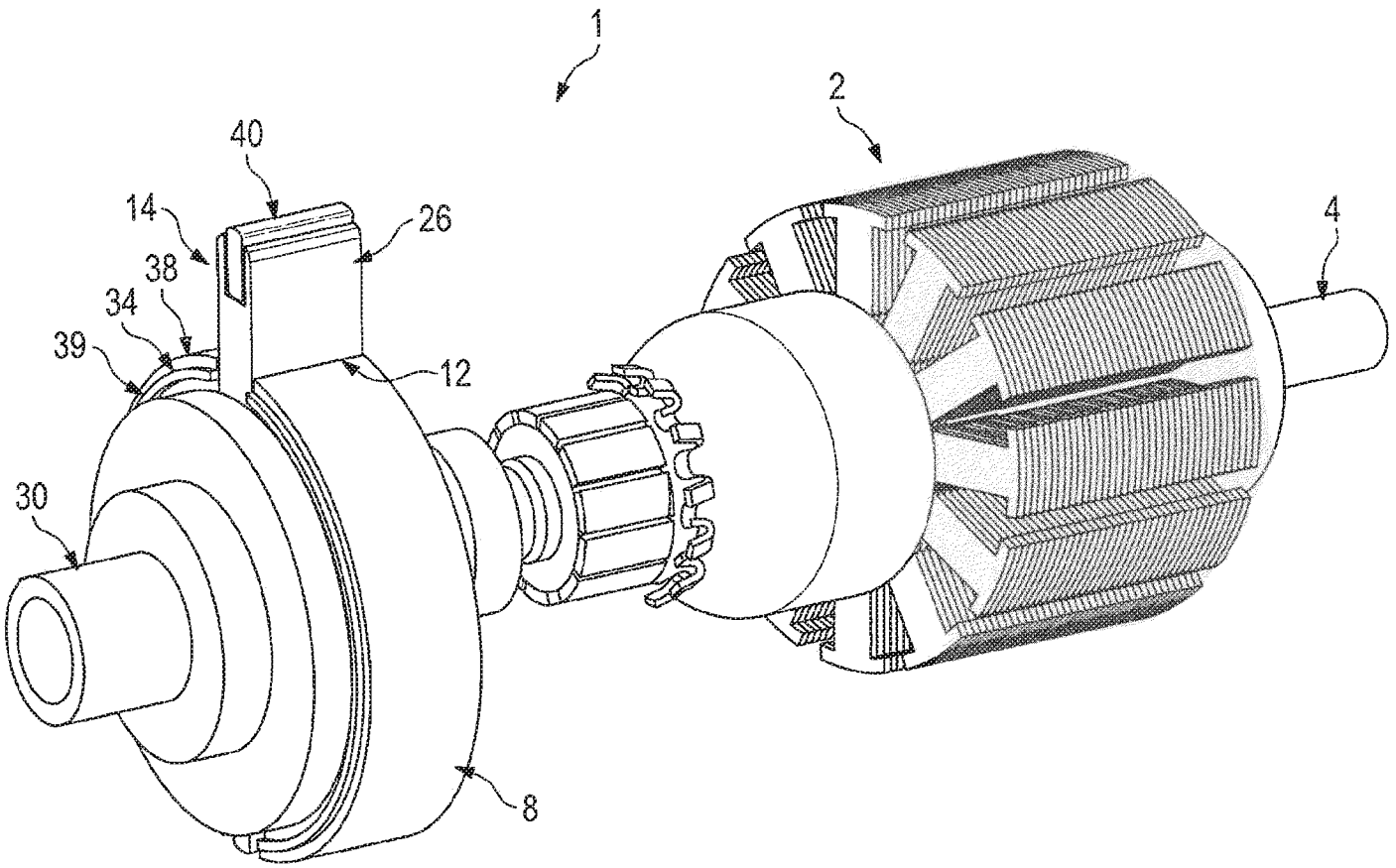
FIG. 6 shows another elevated view of the vacuum pump of FIG. 5.

The rotor 8 comprises first and second circumferentially protruding rims 32, 34, one rim 32 at the bottom side 36 of the rotor 8 and the other rim 34 at the top side 38 of rotor 8. Both rims 32, 34 are received in respective recesses in a bottom and a top wall of the cavity 52 (cf. FIG. 7), thus forming a labyrinth seal. The rims 32, 34 are part of a bearing journal 37 formed between the bottom side 36 of the rotor and a bottom plate 41, and a bearing journal 39 formed between the top side 38 of the rotor 8 and an end plate (not shown in figures), which closes the cavity 52 at the top end (cf. FIG. 7). To further enhance sealing, respective sealing elements 40, 42 are arranged in respective recesses 44, 46 at the ends of the vanes 26, 28 respectively (cf. FIG. 5). Such sealing elements 40, 42 are particularly preferred when the vacuum pump is used as a lubricated vacuum pump, however, may be avoided when used as a dry running vacuum pump without contact between the vane member 14 and an inner circumferential wall of the cavity.

Figure 7:
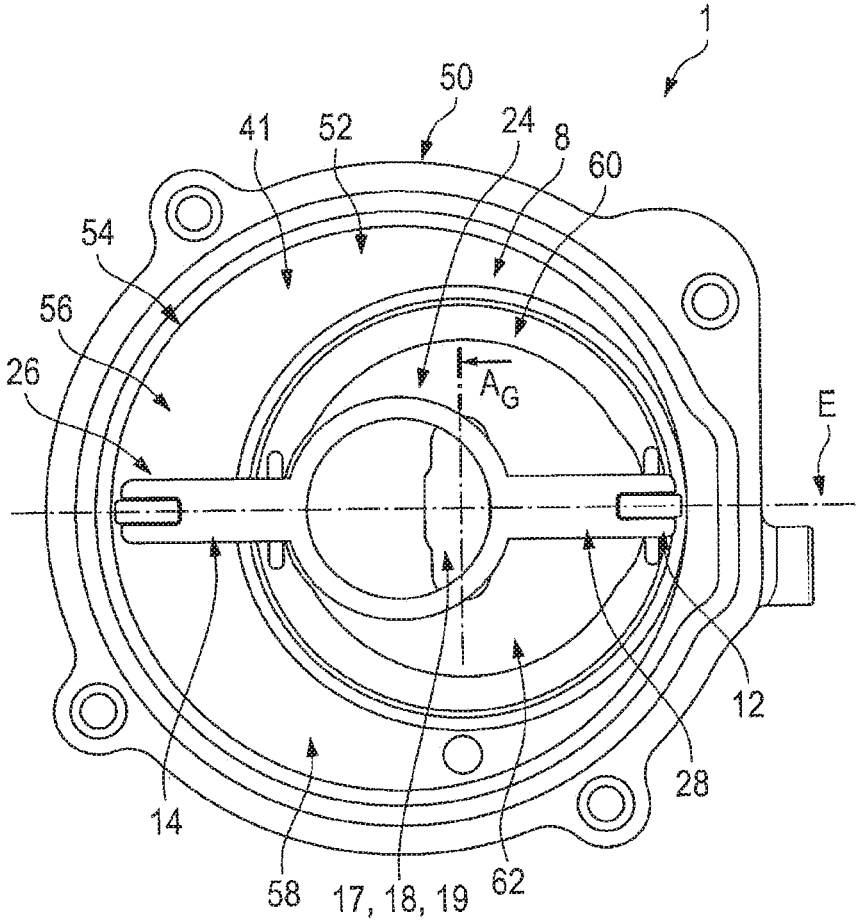
FIG. 7 shows a bottom view into the cavity of the vacuum pump.

In FIG. 7, the vacuum pump 1 is shown with a housing 50. The housing 50 defines a cavity 52 having an inlet and an outlet, which are arranged in the bottom plate, which is not shown in FIG. 7. The cavity 52 includes an inner circumferential wall 54. The cavity 52 is divided into two working chambers 56, 58 by means of the vane member 14. The vane member 14 is formed as a single one-piece member 14 having the central hollow jacket 24 from which the two vanes 26, 28 protrude in opposing directions. The vanes 26, 28 are symmetrically shaped and have the same length measured in radial direction. By means of the central hollow jacket 24, the vane member 14 is coupled to the eccentric element 20 (not shown in FIG. 7). The rotor 8 furthermore comprises a rotor wall 60 which defines a substantially cylindrical outer shape. The rotor wall 60 further defines an inner space 62 in which the drive shaft 6, the eccentric bushing 20 and the hollow jacket 24 are arranged. Thus, the rotor 8 radially encloses the eccentric bushing 20 and the central shaft 6 as well as the hollow jacket 24. The rotor 8 has a fixed position within the cavity 52 and only rotates about its rotational axis AR (cf. FIG. 3).

Furthermore, according to FIG. 7, the guiding recess 18 can be seen. The guiding recess 18 has an axis AG, which runs perpendicular to the plane E defined by the vanes 26, 28 of the vane member 14. The guiding recess 18 is formed such that the crank pin 16 of the drive shaft 6 engages the rotor 8 at predetermined rotational angles α of a revolution of the rotor 8 inside the cavity 52.

Figure 8:
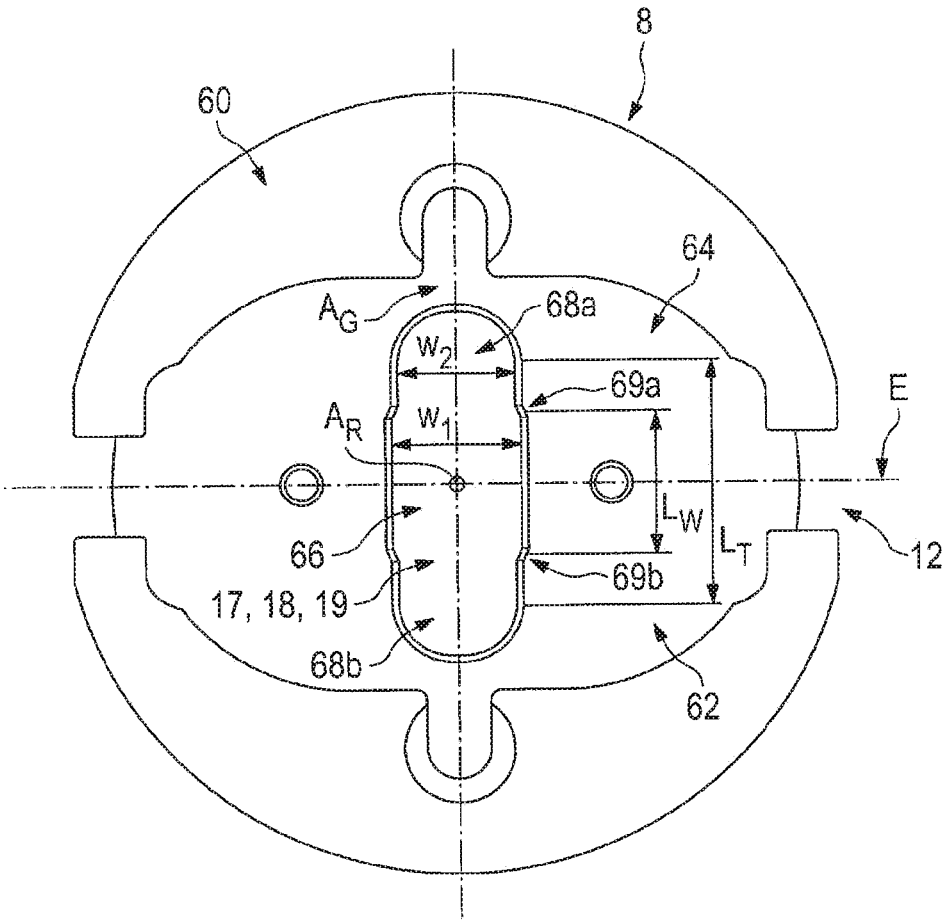
FIG. 8 shows a bottom view of the rotor.

In FIG. 8, a bottom view of the rotor 8 is shown. The rotor 8 comprises a rotor wall 60 and a slot 12 formed in the rotor wall 60 and extending along a plane containing the rotational axis AR of rotor 8. Rotor wall 60 defines an inner space 62 (cf. FIG. 7). The guiding recess 18 is formed in a top wall 64. The longitudinal axis AG of the guiding recess 18, which is formed as a groove 17, namely a blind recess 19, is substantially perpendicular to plane E which is defined by the slot 12 and by the vane member 14 (cf. FIG. 7). The guiding recess 18 comprises a wide portion 66 and two narrow portions 68*a*, 68*b*. The wide portion 66 has a width W1, which is substantially larger than a diameter DC of the crank pin 16 (cf. FIG. 13). The two narrow portions 68*a*, 68*b* are arranged at opposing end portions of the guiding recess and comprise a width W2 perpendicular to longitudinal axis AG, which substantially equals the outer diameter DC of the crank pin. When a crank pin 16 travels through the guiding recess 18 along the longitudinal axis AG, upon rotation of the central shaft 6, the crank pin 18 engages the rotor 8, when in the range of the narrow portions 68*a*, 68*b*, but disengages the rotor 8, when in the wide portion 66. For a more even rotation between the wide portion 66 and the narrow portions 68*a*, 68*b*, two transition portions 69*a*, 69*b* are provided with tapered surfaces. Such a configuration of the guiding recess 18, with a wide portion 66, is preferred, when the vacuum pump 1 comprises a second drive for driving the vane member 14, as it has been described with respect to FIGS. 2 to 5 in particular.

When the vane member 14 is not driven but only passive, it may be provided that the guiding recess 18 has the same width W2 along its axial extension and does not comprise a narrow portion W1. When the crank pin is in the narrow portion W1, force cannot be transmitted from the central shaft 6 to the rotor 8. Due to the arrangement of the guiding recess and the offset of the rotational axis AR of the rotor and rotational axis AS of the driving shaft, the rotor 8 will travel at half speed of the rotational speed of the central shaft 6, which thus allows using an electric motor for driving the vacuum pump, while at the same time keeping the rotational speed of the vacuum pump 1 low, which is beneficial with respect to friction and maintenance issues.

According to this embodiment (FIG. 8) the overall length LW of the wide portion 66 is approximately two-thirds of the total length LT of the guiding recess 18, measured from the outermost points of travel of the crank pin, that is from centers of the radius of the rounded end portions of a guiding recess 18. In rotation this leads to an engagement between the crank pin 16 and guiding recess 18 for a first predetermined angle α of approximately 15° at rotational positions of 90° and 270° of the rotor (cf. FIGS. 16*a* to 16*d*).

Figure 9:
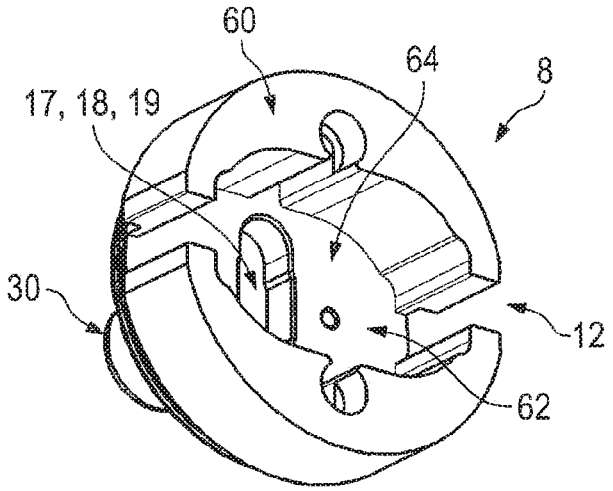
FIG. 9 shows an elevated view of the rotor.
Figure 10:
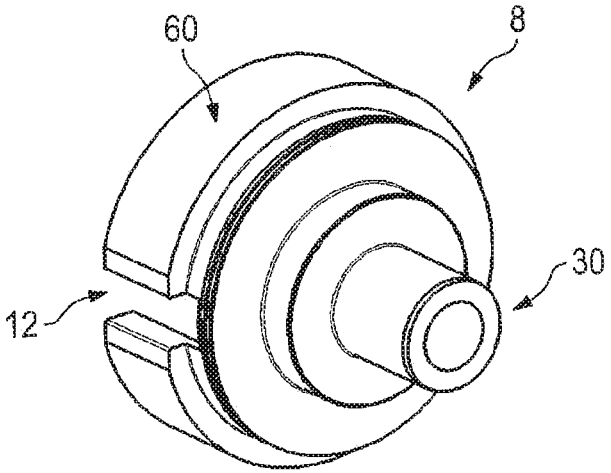
FIG. 10 shows another elevated view of the rotor.

The rotor 8 is formed out of a plastic material preferably by means of injection molding as can be inferred from FIGS. 8 to 10. The rotor 8 does not comprise any undercuts and thus is easy to manufacture.

Figure 11:
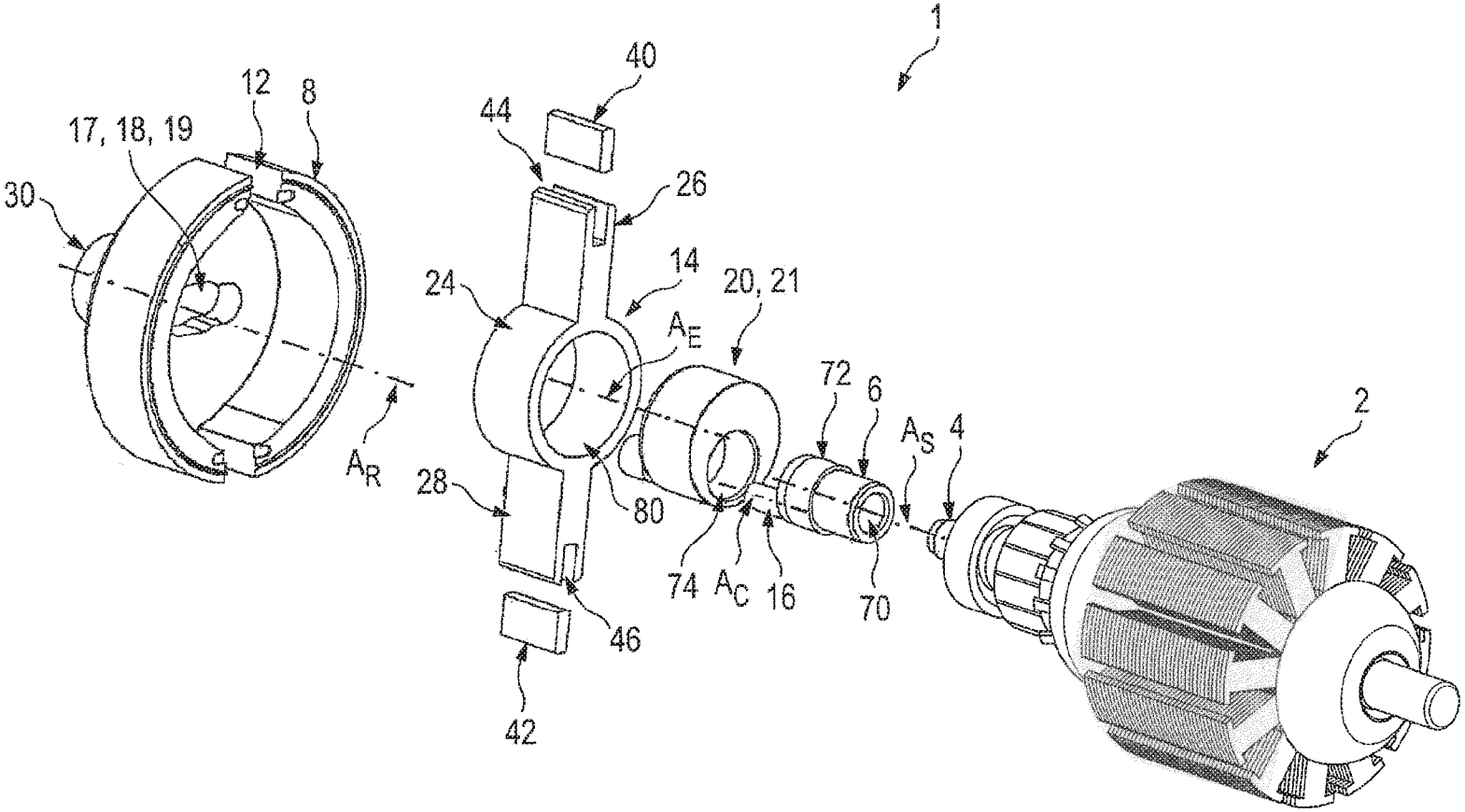
FIG. 11 shows an exploded view of the vacuum pump of FIGS. 2 to 6.
Figure 12:
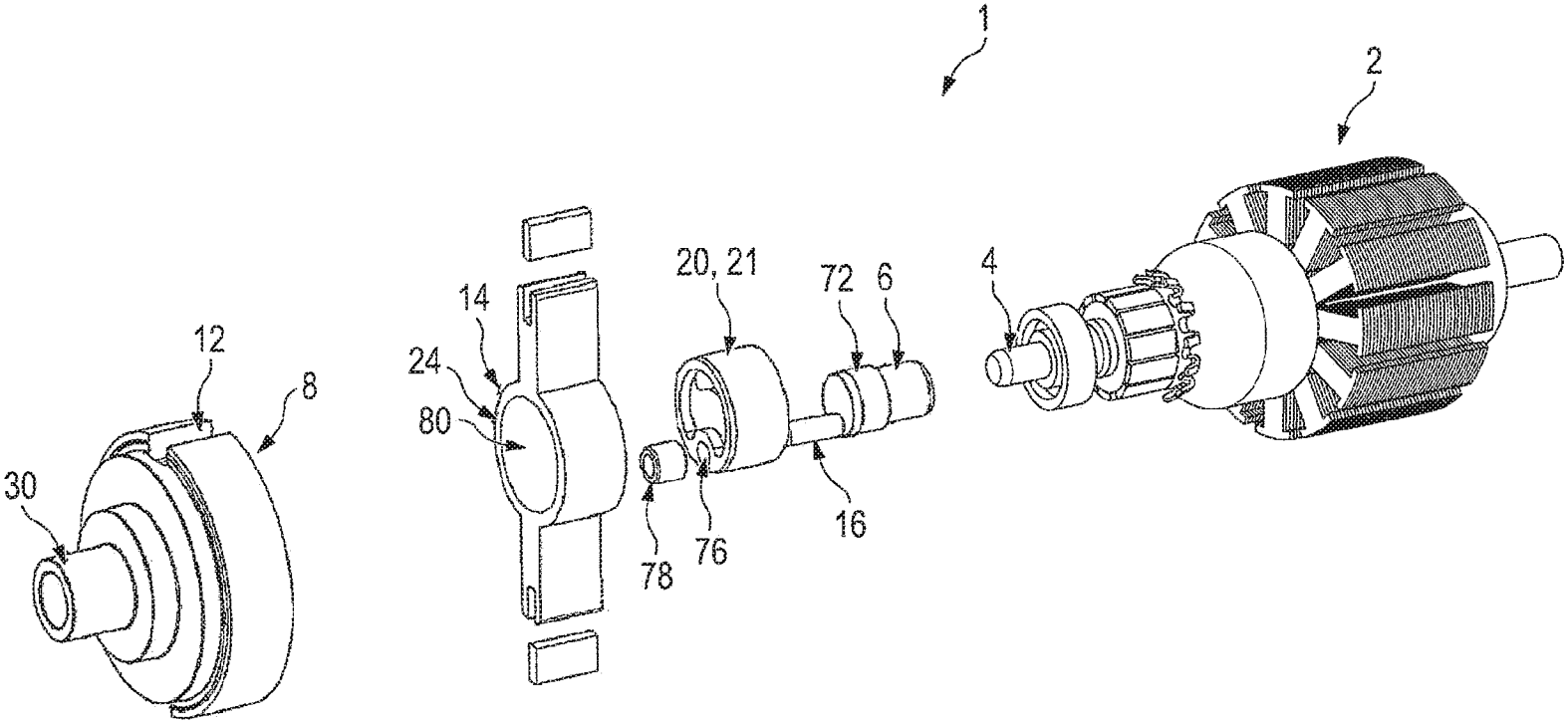
FIG. 12 shows another exploded view of the vacuum pump of FIG. 11.

FIGS. 11 and 12 illustrate the assembly of the vacuum pump 1, in particular the moving parts, namely rotor 8, vane member 14, eccentric bushing 20, drive shaft 6 and rotor shaft 4.

The central shaft 6 comprises an opening 70 which receives a tip of the motor shaft 4. The central shaft 6 furthermore comprises a connection portion 72 having a cylindrical outer surface. The connection portion 72 is adapted to be received in a corresponding recess 74 of the eccentric bushing 20. The recess 74 is eccentrically arranged in the bushing 20 with respect to the central axis AE of the eccentric bushing 20. Inside the recess 74 is a through hole 76 formed through which the crank pin 16 can protrude. Due to the recess 74 and the through hole 76, the central shaft 6 and the eccentric bushing are non-rotatingly to each other connected by means of a form-fit. After exiting the through hole 76, the crank pin 16 is received in a pin sleeve 78, which is rotatingly provided on the crank pin 16. The pin sleeve 78 forms the outer surface of the crank pin and comes into contact with the inner wall portions of the guiding recess 18. The pin sleeve 78 is not mandatory, but beneficial with respect to friction reduction.

The eccentric bushing 20 is received inside the space 80 of the hollow jacket 24, forming a rotatable connection, and the vane member 14 is received in the rotor 8 by means of the two vanes 26, 28 which are seated in the slot 12. Furthermore, sealing elements 40, 42 are received in recesses 44, 46 respectively.

Figure 14:
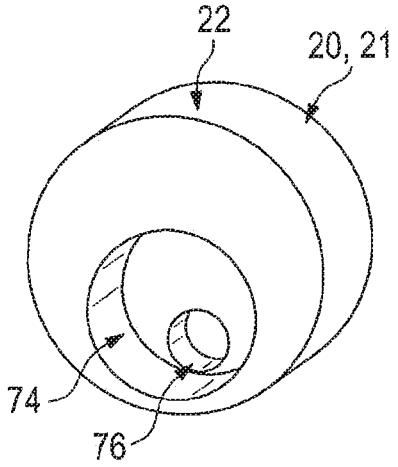
FIG. 14 shows an elevated view of an eccentric bushing.
Figure 15:
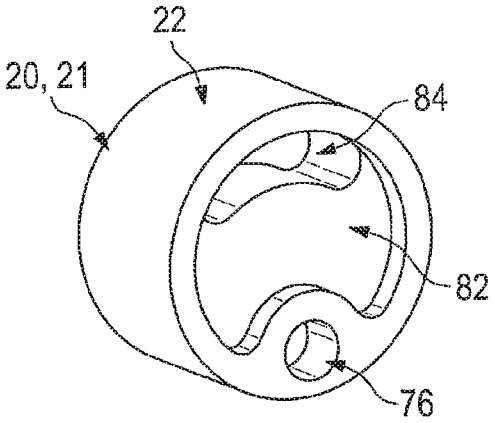
FIG. 15 shows another elevated view of the eccentric bushing of FIG. 14.
Figure 16A:
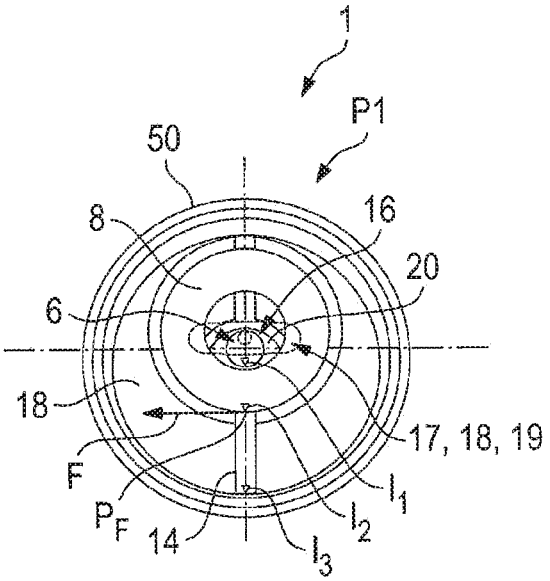
FIGS. 16*a* to 16*d* illustrate different rotational positions of the vacuum pump.
Figure 16B:
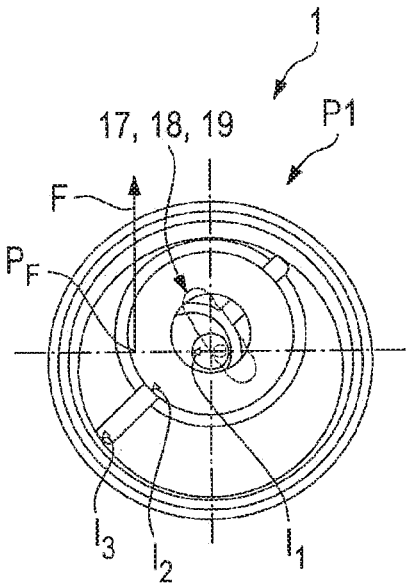
Figure 16C:
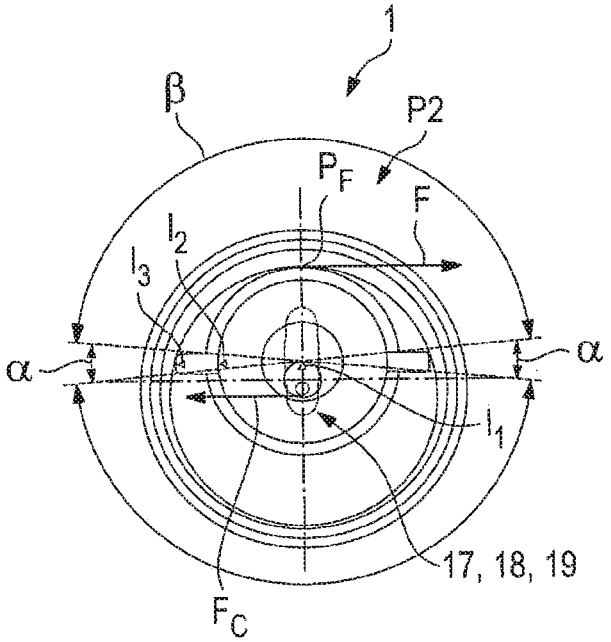
Figure 16D:
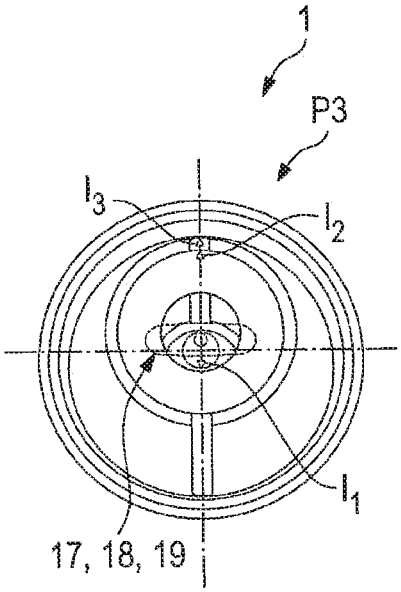

Now turning to FIGS. 14 and 15 in particular, the eccentric bushing 20 is shown. From FIG. 14, a bottom view is shown, in which the recess 74 and the through hole 76 can be seen. In FIG. 14, a respective top view is shown. It can be seen that in the top section of the bushing 20 a first substantial planar recess 82 is formed and a second recess 84 which has a greater depth and is curved and opposingly arranged with respect to the crank pin 16. When forming the recesses 82, 84 appropriately and choosing materials of the central shaft 6 and the eccentric bushing 20 appropriately, it is possible to balance inertia forces, generated by means of the eccentric arrangement of the crank pin 16 and the eccentric bushing 20 with respect to the drive shaft 4. According to this arrangement, an additional balance weight or the like is not necessary.

Now turning to FIGS. 16*a* to 16*d*, the drive mechanism will be explained, when using the two drive mechanisms, the eccentric one for driving the vane member 14 and the crank pin 16 for driving the rotor 8 in a predetermined angle $\alpha$. FIGS. 16*a* to 16*d* illustrate the movement of the moving parts during an operation. It is shown how the rotor 8 rotates and how the vane member 20 moves upon a full rotation of the central shaft 6, and how the crank pin 16 moves within the guiding recess 18. The main parts are indicated with reference signs in FIG. 16*a*; in FIGS. 16*b* to 16*d*, these reference signs are left away to simplify the illustration. It will be understood that FIGS. 16*a* to 16*d* show the same parts as in FIG. 16*a*, however, in different rotational positions as now will be described.

The rotor 8, the central shaft 6 and the vane member 14 are provided with indicators I1, I2, I3 in the form of arrows for indicating a rotational position of these parts. According to FIG. 16*a*, all three indicators I1, I2, I3 direct to the bottom of FIG. 16*a* and thus, compared to a watch, all three indicators I1, I2, I3 direct to the six o'clock position. When now for example the central shaft 6 is rotated in a clockwise direction about 90° about its rotational axis AS (cf. FIGS. 2, 11 and 13), the eccentric bushing 20 which is seated on the central shaft 6 is rotated about 90° degree as well as the central axis AE of the eccentric bushing 20 and thus, the point of action of the eccentric bushing 20 moves on a circle segment about 90° from the six o'clock position to the nine o'clock position. In the same manner also the crank pin 16 moves. Since the vane member 14 engages the eccentric bushing 20 in that the central hollow jacket 24 is seated about the eccentric bushing 20, the point of action of the vane member 14, which is identical to the central axis AE of the eccentric bushing 20, is moved to the 9 o'clock position accordingly. However, since the vane member 14 is not freely movable, but positively coupled to the rotor 8 by means of the slot 12 (cf. also FIGS. 2, 5 and 7 in particular), the vane member 14 cannot move in a direction perpendicular to the vanes 26, 28 of the orientation of FIG. 16*a* without rotation. Therefore, the vane member 14 and the rotor 8 are forced to rotate about 45° together as indicated by the indicators I2, I3 accordingly to FIG. 16*b*. Since the crank pin 16 is coupled to the drive shaft 6 and the guiding recess 16 is formed in the rotor 18, also the crank pin 16 travels inside the guiding recess 18, while in the positions shown in FIGS. 16*a* and 16*b*, the crank pin 16 is still remaining in the wide portion 66 and not engaging the rotor 8. Thus, the vacuum pump 1 is moved from a first rotational position P1 to an intermediate position PI (cf. FIG. 16*b*).

When the central shaft 6 rotates on to a 180° position (cf. FIG. 16*c*), the indicator I1 directs to the 12 o'clock position and the point of action of the vane member 14, which is again identical to the central axis AE of the eccentric bushing 20, is further rotated about the rotational axis AS of the central shaft 6 and thus, both, the vane member 14 and the rotor 8 are rotated about 19°, so that the indicators I2, I3 direct to the nine o'clock position. In this position, it can be seen that the resulting force F acting from the eccentric bushing 20 on the vane member 14 is parallel to a plane defined by the vanes 26, 28 while at the same time the central axis AE of the eccentric bushing 20 crosses the rotational axis AR of the rotor 8. A moment arm in this position P2 (FIG. 16*c*) becomes zero and no rotational force is induced to the vane member 14, but the vane member 14 only is pushed along the plane defined by the vanes and with respect to FIG. 16*c* to the right hand side. This could lead to a contact between the right hand side vane and the circumferential wall of the vacuum pump 1, thus resulting in wear. According to the present invention however, the crank pin 16 has further travelled through the guiding recess 18 and is now (cf. FIG. 16*c*) in the narrow portion 68 of the guiding recess thus engaging the rotor 8. The crank pin 16 in this position cranks the rotor 8 and pushes the rotor 8 by means of a pushing force FC into rotation, thus indirectly driving the vane member 14.

Upon further rotation (from position P2 to position P3, FIG. 16*d*) rotor 8 and vane member 14 are further rotated and the crank pin 16 travels back through the guiding recess 18 to the white portion 66, thus engaging the rotor 8, while the vane member 14 again is driven by means of the eccentric bushing 20. In the first position P1 and the intermediate position PI, the driving force F from the eccentric bushing 20 to the vane member 14 is substantially perpendicular to the plane of the vane member 14 (cf. FIG. 16*a*) or at least acute (cf. FIG. 16*b*). In these positions, the crank pin 16 disengages the rotor 8, while in the position shown in FIG. 16*c*, the crank pin 16 engages the rotor 8 via the guiding recess 18. This happens in two positions of the total revolution of the rotor 8, namely in the 90° and to 170° positions (the 170° position is similar to FIG. 16*c*, while indicators I2, I3 would direct to the right hand side and indicator I1 to the bottom). As also can be seen from FIGS. 16*a* to 16*d*, rotor 8 and vane member 14 travel at half speed of the speed of the drive shaft 6.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 vacuum pump
2 rotor of motor
4 motor shaft
6 central shaft
8 drivable rotor
10 outer wall
12 slot
14 vane member
16 crank pin
17 groove
18 guiding recess
19 blind recess
20 eccentric element
21 eccentric bushing
22 surface of eccentric bushing
24 central hollow jacket
26, 28 vanes
30 shaft end
32, 34 circumferentially protruding rims
36 bottom side
37 bearing journal
38 top side
39 bearing journal
40, 42 sealing elements
41 bottom plate
44, 46 recesses
50 housing
52 cavity
54 inner circumferential wall
56, 58 working chambers
60 rotor wall
62 inner space
64 top wall
66 wide portion
68*a*, 68*b* narrow portions
69*a*, 69*b* transition portions
70 opening
72 connection portion
74 recess
76 through hole
78 pin bushing
80 space
82, 84 recesses
α First (predetermined) rotational angle
β Second (predetermined) rotational angle
AE Point of action (of the vane member)
AS Rotational axis (of the central shaft)
AR Rotational rotor-axis
e1 First offset
e2 Second offset
LT Moving length (of the wide portion)
LW Axial length (of the crank pin)
w1 Second width
w2 First width

The invention claimed is:

1. A rotating vane vacuum pump comprising:
a housing defining a cavity having an inlet and an outlet;
a vane member inside the cavity;
a drivable rotor inside the cavity, the drivable rotor having a guiding recess; and
a rotatable central shaft extending through the cavity, the rotatable central shaft having a crank pin;
wherein the vane member is slidably arranged in the rotor,
wherein the vane member and the rotor are rotationally coupled together and configured to undergo a 360° rotation,
wherein, over a first predetermined angular range of the 360° rotation, the crank pin is configured to engage the guiding recess in order to directly drive the rotor through the first predetermined angular range, and
wherein, over a second predetermined angular range of the 360° rotation, the crank pin is configured to be disengaged from the guiding recess such that the crank pin does not directly drive the rotor through the second predetermined angular range.

2. The rotating vane vacuum pump according to claim 1, wherein the guiding recess is in the form of a groove.

3. The rotating vane vacuum pump according to claim 2, wherein the groove extends in a direction substantially perpendicular to a plane defined by the vane member.

4. The rotating vane vacuum pump according to claim 1, wherein the guiding recess comprises at least one narrow portion having a first width substantially corresponding to an outer diameter of the crank pin, and at least one wide portion having a second width substantially larger than the outer diameter of the crank pin.

5. The rotating vane vacuum pump according to claim 4, wherein an axial length of the wide portion is in a range of ⅔ of a moving length of the crank pin in the guiding recess.

6. The rotating vane vacuum pump according to claim 4, wherein the guiding recess is formed such that the first predetermined angular range has a magnitude in the range of 20° to 5°.

7. The rotating vane vacuum pump according to claim 1, wherein the guiding recess is formed as a blind recess.

8. The rotating vane vacuum pump according to claim 1, wherein the crank pin comprises a pin sleeve for contacting wall portions of the guiding recess.

9. The rotating vane vacuum pump according to claim 1, wherein the vane member is coupled to the central shaft by an eccentric element on the central shaft.

10. The rotating vane vacuum pump according to claim 9, wherein the eccentric element on the central shaft is configured to directly drive the vane member through the second predetermined angular range.

11. The rotating vane vacuum pump according to claim 9, wherein the eccentric element is formed as an eccentric bushing which is arranged on the central shaft.

12. The rotating vane vacuum pump according to claim 9, wherein the eccentric element is non-rotatably coupled to the central shaft by the crank pin.

13. The rotating vane vacuum pump according to claim 9, wherein the vane member comprises a central hollow jacket, and wherein the vane member is rotatably seated about the eccentric element by the central hollow jacket.

14. The rotating vane vacuum pump according to claim 13, wherein the vane member is formed as a single one-piece vane member having first and second vanes on the central hollow jacket protruding in a radial direction on opposing sides of the central hollow jacket.

15. The rotating vane vacuum pump according to claim 9, wherein the first offset of the rotational axis of the central shaft relative to the rotational rotor-axis of the rotor is substantially identical to the second offset of the point of action of the vane member relative to the rotational axis of the central shaft.

16. The rotating vane vacuum pump according to claim 1, wherein the vane member is configured to be directly driven by the central shaft, and wherein the guiding recess is formed such that the first predetermined angular range corresponds to a drive moment on the vane member being less than a threshold.

17. The rotating vane vacuum pump according to claim 1, wherein the rotor comprises at least one bearing journal for bearing the rotor against a bottom plate and/or an end plate of the cavity.

18. A method for driving the rotating vane vacuum pump according to claim 1, the method comprising:

directly driving the rotor along the first predetermined angular range; and directly driving the vane member along the second predetermined angular range.

19. The method according to claim 18, wherein the rotor is indirectly driven by the vane member when the vane member is directly driven, and wherein the vane member is indirectly driven when the rotor is directly driven.

20. The method according to claim 18, wherein the first predetermined angular range has a magnitude in the range of 20° to 5°.

* * * * *